US006669125B1

(12) United States Patent
Howard

(10) Patent No.: US 6,669,125 B1
(45) Date of Patent: Dec. 30, 2003

(54) SOLIDS REDUCTION PROCESSOR

(75) Inventor: Wendell E. Howard, Austin, TX (US)

(73) Assignee: Dynacorp Engineering Inc., Austin, TX (US)

( * ) Notice: Subject to any disclaimer, the term of this patent is extended or adjusted under 35 U.S.C. 154(b) by 0 days.

(21) Appl. No.: 09/935,103

(22) Filed: Aug. 22, 2001

(51) Int. Cl.[7] ..... B02C 13/286
(52) U.S. Cl. ..... 241/187; 241/188.1; 241/287
(58) Field of Search ..... 241/187, 188.1, 241/287, 604

(56) References Cited

U.S. PATENT DOCUMENTS

| | | | | |
|---|---|---|---|---|
| 489,079 | A | * | 1/1893 | Kellner |
| 1,458,387 | A | * | 6/1923 | Bourne |
| 2,705,596 | A | | 4/1955 | Poyser et al. |
| 2,774,543 | A | * | 12/1956 | Keller et al. |
| 3,327,955 | A | | 6/1967 | Tyler |
| 5,400,977 | A | | 3/1995 | Hayles, Jr. |
| 5,544,820 | A | | 8/1996 | Walters |
| 5,947,396 | A | | 9/1999 | Pierce |
| 5,954,281 | A | | 9/1999 | Hayles, Jr. |

FOREIGN PATENT DOCUMENTS

| | | |
|---|---|---|
| DE | 1027964 | 4/1958 |

* cited by examiner

*Primary Examiner*—Mark Rosenbaum
(74) *Attorney, Agent, or Firm*—James W. Huffman

(57) ABSTRACT

A processor for reducing solids from a predefined input size to a predefined output size is provided. The processor includes a base, an enclosed cylinder, a pair of rotor assemblies (each driven by its own motor) having a plurality of disk sets, the disk sets having a plurality of hammers thereon. As the rotor assemblies spin, the hammers cause the solids to be reduced. The processor further includes two inlet ports for receiving solid material, and an outlet or discharge port for exiting the reduced solid material. Additionally, the processor includes legs for varying the incline of the inlet ports with respect to the outlet port, vanes to create lift on the inlet port side of the cylinder, flow restrictor plates to restrict solids flow within the cylinder, and baffle plates to prevent material build up within the cylinder.

16 Claims, 13 Drawing Sheets

SOLIDS REDUCTION PROCESSOR

FIELD OF THE INVENTION

This invention relates in general to the field of dry solids reduction, and more specifically to a commercial machine for reducing solid materials.

BACKGROUND OF THE INVENTION

Solids reduction is the process by which certain materials are ground, crushed or pulverized from a certain input size to a prescribed output size. Industry examples of such solids reduction include but are not limited to the following:

| INDUSTRY | TYPICAL APPLICATIONS |
|---|---|
| CEMENT | Clinker, coal, pet coke, pozzolans |
| MINING | Ore Processing, Phosphate rock, copper, zinc, gold, bauxite, silver, etc. |
| UTILITY | Coal, pet coke, biomass, environmental applications, fly ash |
| CHEMICAL | Raw material processing, pharmaceuticals |
| OIL AND GAS | Drilling waste injection, processing, environmental remediation |
| PAPER | Kaolin clay, coal fired power generators |
| AGRICULTURE | Soy bean oil, cotton seed oil, grains, animal feeds |

Various devices have been developed and utilized to reduce the size of solids such as those listed above. One such device is called a ball mill. A ball mill is a cylindrical or conical shell that rotates about a horizontal axis, and is partially filled with a grinding medium such as natural flint pebbles, ceramic pellets or metallic balls. The material to be ground is added so that it slightly more than fills the voids between the pellets. The shell is rotated at a speed which causes the pellets to cascade, thus reducing particle sizes by impact. While ball mills have been successfully used in a number of industries, the amount of material they are able to process is often less (per hour) than other devices that actively hammer, crush or otherwise pulverize solids. In addition, the electrical cost required to operate a ball mill, per ton of resultant processed solid, can be expensive and even cost prohibitive.

Another device that has been used to reduce solids is described in U.S. Pat. No. 5,947,396 (Pierce), U.S. Pat. No. 5,400,977 (Hayles, Jr.), and in U.S. Pat. No. 5,954,281 (Hayles, Jr.). The device described in these patents was developed to receive material in a slurry condition such as drill cuttings from a well bore, where the slurry material passes through a pulverizer, or collider, (a series of rotating disks having thrust guides to contact the slurry) thereby reducing the size of the drill cuttings. However, when solid materials that are not in a slurry condition are passed through such a device, many problems exist. For example, since solid material is not "fluid", there is a tendency for reduced material to collect in cavities within the device and not proceed to an outlet or drain. This increases wear to the thrust guides, raises operating temperatures, and creates a degenerative variation in the size of the resultant processed solid. In addition, the device is designed to receive slurry through a single input in the middle of the chamber. However, when solid material is presented in the center of the chamber, it is contacted by thrust guides on their downward stroke, and driven to the bottom of the device. This is problematic for the reason described above. In addition, it is also damaging to the thrust guides thereby creating increased wear.

One skilled in the art will appreciate that the above devices are not exhaustive, but are merely representative of the types of machines used to reduce solid material.

Therefore, what is needed is a device that can cost effectively reduce solids in a dry or suspended state to a predefined size.

Furthermore, what is needed is a device that can receive dry solids of various sizes and reduce them to a variety of different predefined resultant sizes.

And, what is needed is a durable device that can withstand the wear and abuse of processing solids that are in either a dry or fluid state.

SUMMARY

The present invention provides a machine for processing of dry solids that is durable, cost effective, and configurable, for processing dry solids of various sizes into a range of predefined sizes.

In one aspect, the present invention provides a solids processor including an enclosed cylinder, a pair of rotor assemblies, motor means, and a pair of inlet ports. The enclosed cylinder encloses solid materials provided thereto. The pair of rotor assemblies spin disk sets to hammer the solid materials. The motor means are coupled to the pair of rotor assemblies and cause the rotor assemblies to spin. The pair of inlet ports are provided along the top of the cylinder, to receive the solid materials and to transmit the solid materials to the enclosed cylinder.

In another aspect, the present invention provides a solids processor having an enclosed cylinder, a pair of rotor assemblies, motor means, and a plurality of baffle plates. The enclosed cylinder encloses solid materials provided thereto. The pair of rotor assemblies spin disk sets to hammer the solid materials. The motor means are coupled to the pair of rotor assemblies to cause the rotor assemblies to spin. The plurality of baffle plates are secured within selected cavities within the enclosed cylinder to prevent build up of the solid materials within the cavities.

In yet another aspect, the present invention provides a processing device to reduce in size solid material. The processing device includes a base frame, a pulverizer and incline means. The pulverizer is coupled to the base frame, to receive the solid material, and to reducing the size of the solid material. The incline means are coupled to the base frame, to selectably adjust the height of a first end of the pulverizer relative to a second end of the pulverizer, thereby varying the amount of time the solid material is processed by the pulverizer.

In a further aspect, the present invention provides a solids processor having two rotor assemblies which spin opposite to each other, the two rotor assemblies for reducing solid material to a predefined size. The solids processor includes for each of the two rotor assemblies, a plurality of disk sets, the plurality of disk sets each having a plurality of hammers for hammering the solid material; and a plurality of vains, secured to selected ones of the plurality of disk sets, the plurality of vains creating lift within said solids processor.

In yet another aspect, the present invention provides a solids processing device having motor means that spin a pair of rotor assemblies in opposite directions. The solids processing device includes: a pair of interconnected cylindrical chambers which are in fluid communication and in overlapping relating along their length, the pair of chambers having an inlet end and an outlet end, the rotor assemblies positioned within the pair of chambers for hammering solid material; and a plurality of flow restrictor plates, secured internally within the pair of chambers, and positioned around the rotor assemblies, the plurality of flow restrictor plates for restricting the flow of the solid material from the inlet end to the outlet end.

Other features of the present invention will become apparent upon study of the remaining portions of the specification and drawings.

DETAILED DESCRIPTION

Figure 1:
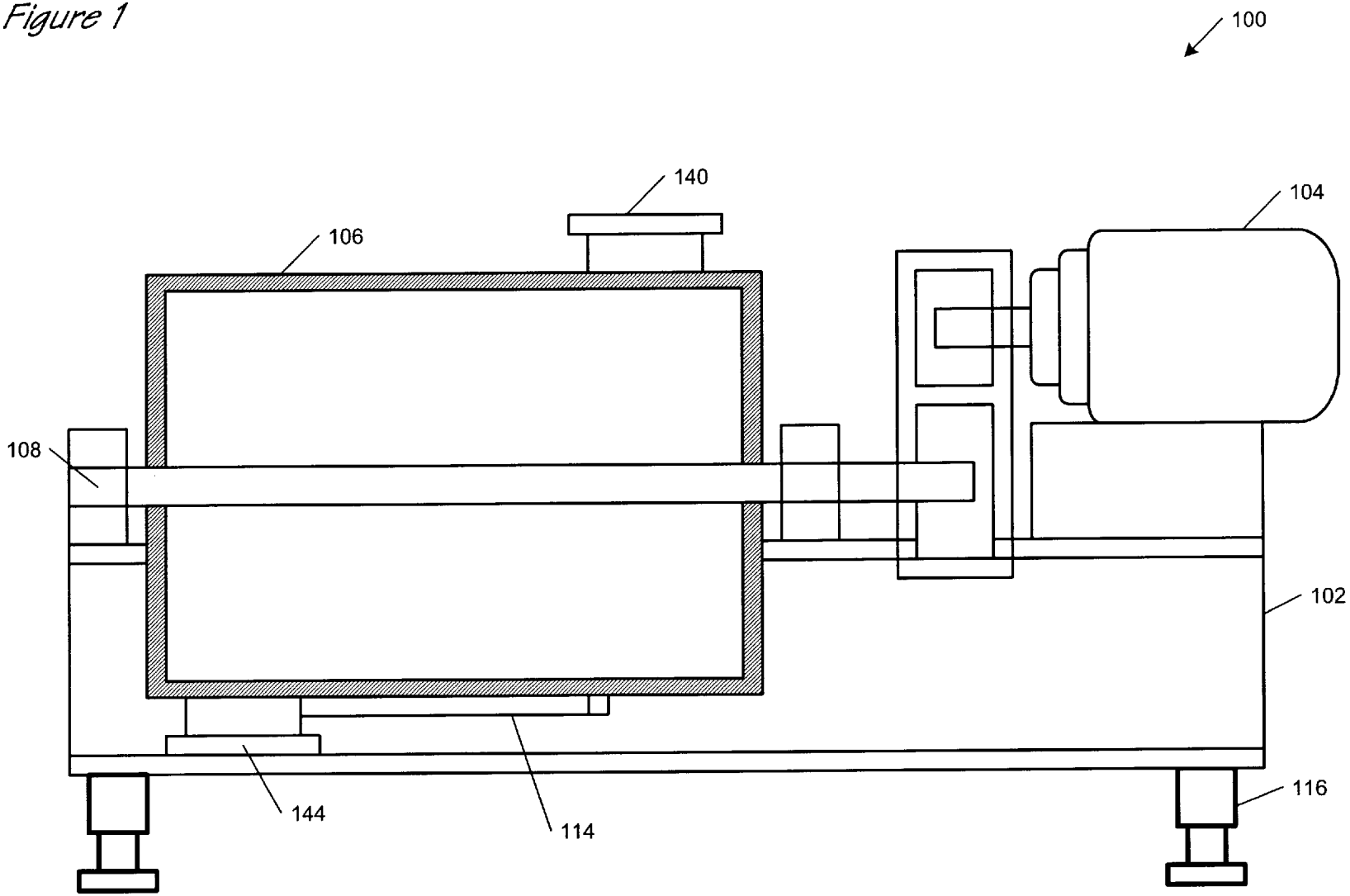
FIG. 1 is side view of a solids reduction processor according to the present invention.

Referring to FIG. 1, a block diagram 100 is shown illustrating a dry solids processor (or pulverizer) 100 according to the present invention. The processor 100 includes a base frame 102, a motor 104, an enclosed cylinder 106, a rotor assembly 108, an inlet 140, a discharge outlet 144, a trough 114, and legs 116. The enclosed cylinder 106 is actually a pair of interconnected cylinders having an internal wear plate made of half inch abrasion resistant steel, and an external plate of half inch steel that conforms to the outer dimensions of the internal wear plate. Each of these elements will be further described in the following drawings. In operation, solids are presented to the inlet 140 for reduction. The motor (or pair of motors) 104 cause the rotor assembly (or pair of rotor assemblies) 108 to rotate at high speed, thereby reducing the solids as they proceed from the inlet 140 to the discharge outlet 144. In one embodiment, the processor has a base 102 of dimension twelve feet in length by eight and a half feet in width. The motor 104 varies in size, depending on the application, from 25 HP to 300 HP (per shaft). The processor 100 is capable of producing fifteen to more than two hundred tons of reduced solids per hour, depending on the size of the motor, the size of the input material, and the prescribed size of the output. In addition, the trough 114 is approximately eight inches wide by two and three quarter inches deep and extends twenty seven and a half inches along the center of the cylinder 106 from the outlet port 144 towards the inlet 140.

Figure 2:
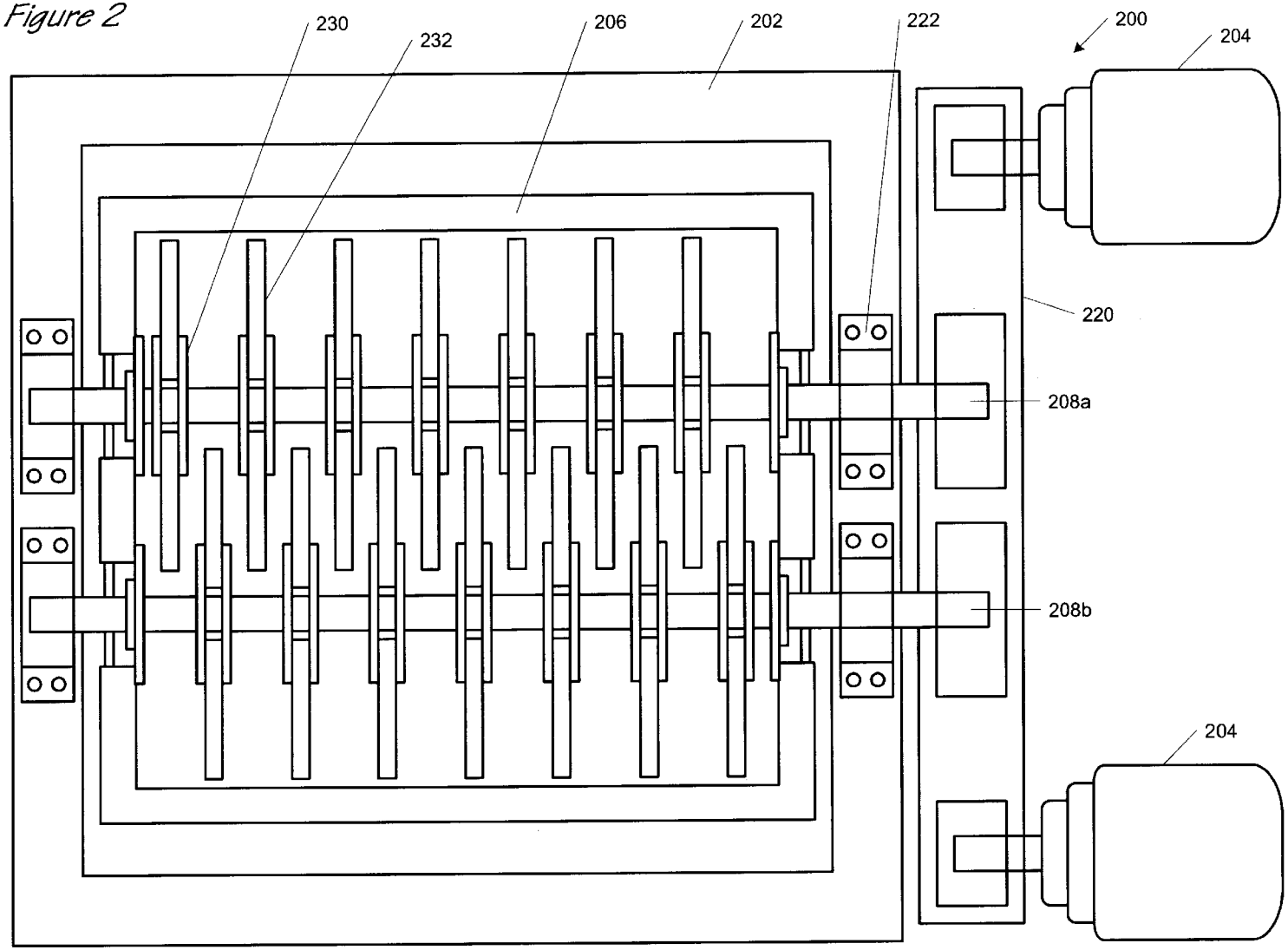
FIG. 2 is a top-down view of a solids reduction processor according to the present invention.

Referring now to FIG. 2, a top-down view of a solids processor 200 is shown. Like elements have like numerical references with the hundreds digit being replaced by "2". The top-down view 200 particularly illustrates a pair of motors 204 for driving a pair of rotor assemblies 208 in a counter rotating fashion. More specifically, both rotor assembly 208*a* and rotor assembly 208*b* rotate towards each other, from the outside of the enclosed cylinder 206 towards the center of the enclosed cylinder 206. One skilled in the art will appreciate that the motors 204 may be interconnected to the rotor assemblies 208 either directly, or via a belt drive interconnection mechanism 220. The rotor assemblies 208 are shown rotatably secured to the base 202 via block bearings 222 so that during rotation, their relative position with respect to the enclosed cylinder 206, and with respect to each other remains constant.

Each of the rotor assemblies 208 contains a number of disk sets 230 having one or more hammers 232 secured thereon. Details of the disk sets 230 and hammers 232 will be further described below with reference to FIGS. 10–12. In one embodiment, each of the rotor assemblies 208 includes seven disk sets 230. In operation, solids are introduced into one end of the enclosed cylinder 206, and are hammered by the counter rotating hammers 232 until they are forced out through the discharge outlet.

Figure 3:
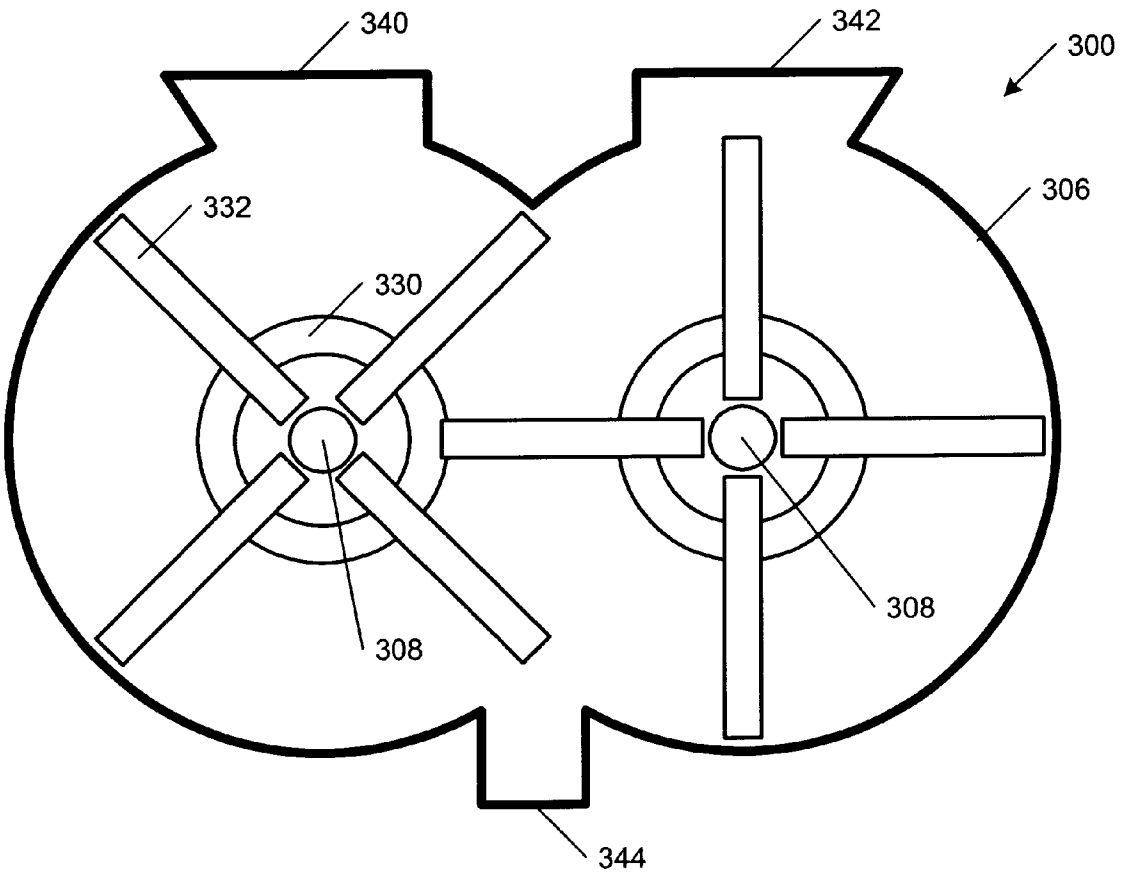
FIG. 3 is an end view of a containment cylinder of a solids reduction processor according to the present invention particularly illustrating inside shafts, disks and hammers.

Referring now to FIG. 3, an end view 300 of the inside of an enclosed cylinder 306 is shown. Like elements have like reference numerals with the hundreds digit being replaced with a "3". The enclosed cylinder 306 as shown has two rotor assemblies 308, with a number of disk sets 330. Each of the disk sets 330 includes four hammers 332 for hammering solid materials. In one embodiment, the enclosed cylinder includes two inlet ports 340 and 342, and one discharge or outlet port 344. The inlet ports 340 and 342 are placed at the motor end of the enclosed cylinder 306, with the discharge port 344 placed at the distal end. This is more specifically shown in FIG. 4 to which attention is now directed.

Figure 4:
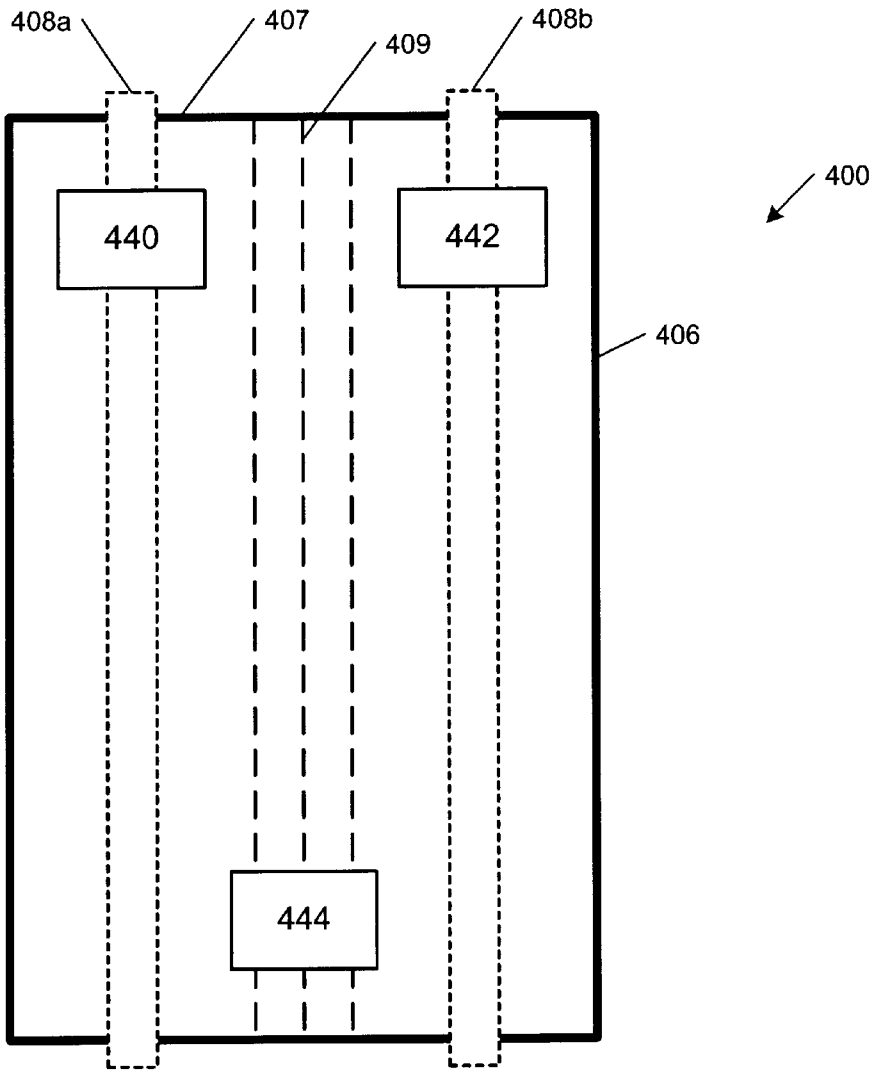
FIG. 4 is a top-down view of a containment cylinder of a solids reduction processor according to the present invention illustrating two-inlets on one end and one discharge outlet on the other end.

FIG. 4 provides a top down view 400 of the enclosed cylinder 406, particularly illustrating a left inlet port 440, a right inlet port 442, and a discharge or outlet port 444. In one embodiment, the inlet ports 440 and 442 have dimensions of eight and a half inches by thirteen and a half inches. An opening of 8.5" by 13.5" for each inlet port easily allows material up to approximately two to three inches to flow into the enclosed cylinder 406 without clogging the inlet ports 440, 442. In one embodiment, the inlet ports 440, 442 are positioned seven inches from the outer edge of an end plate 407, and twelve inches from a center line 409 of the enclosed cylinder 406. Such position of the inlet ports 440, 442 places each inlet port over the center (approximately) of the rotor assemblies 408*a*, 408*b*, respectively.

As mentioned in the background above, a single inlet port positioned along the center line of the enclosed cylinder 406 causes material to drop vertically into the enclosed cylinder 406. Since the rotor assemblies 408 counter rotate towards the center, materials dropped into the middle of the enclosed cylinder 406 are first contacted by blades on the rotor assemblies 408 on their downward stroke. These two actions (vertical drop and downward stroke) cause solid material to be pinned against the floor of the enclosed cylinder 406. Thus, material can accumulate in the bottom center of the cylinder 406 and spread to the outer wall. The hammers on the rotor assemblies 408 are forced to plow through this pile at a high rpm rate, resulting in accelerated hammer wear and deteriorating performance.

By using two inlets 440, 442 positioned over the center of each of the rotor assemblies 408*a,b*, each of the rotor assemblies 408*a,b* sees one-half of the feed load. Feed flowing from the inlets 440, 442 to each rotor assembly 408*a,b* is more tangential than vertical. In other words, material dropped into the inlets 440, 442 travels in an outside-to-inside direction, in the direction of the rotating assemblies 408*a,b*. Hammers on the rotor assemblies 408*a,b* contact the material at the top of their rotation, throwing material predominately across the enclosed cylinder 407 rather than to the floor, thereby causing the material to smash into particles accelerated by the opposing rotor assembly. The result of using two inlet ports 440, 442 is improved contact efficiency and extended blade wear because of a reduced tendency for material to pile up on the floor of the cylinder 406.

Figure 5:
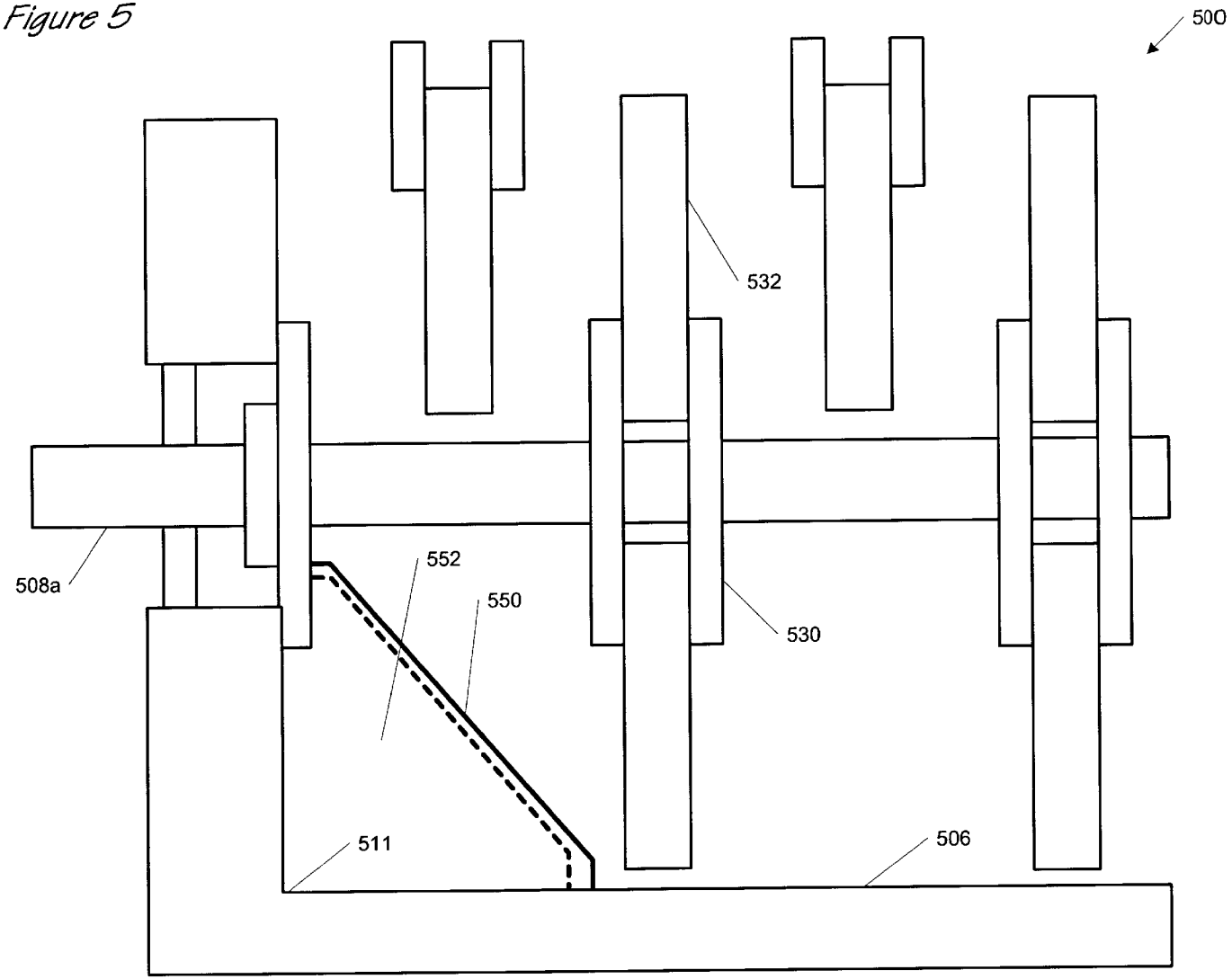
FIG. 5 is an enlarged view of a portion of the containment cylinder particularly illustrating a baffle plate.

Referring now to FIG. 5, an enlarged view 500 of the top left corner of the enclosed cylinder 506 is shown. As above, like elements are referenced with like numerals, with the hundreds digit replaced with a "5". Within the cylinder 506 is a rotor assembly 508*a*, having a plurality of disk sets 530 upon which hammers 532 are attached. Also shown is a baffle plate 550 secured across an open cavity within the cylinder 506.

Unlike solids suspended within a liquid or slurry, dry solids tend to accumulate within cavities that are not being exercised by some mechanism. Therefore, to reduce the "dead space" or cavities within the cylinder 506, one or more baffle plates 550 are installed in one or more corners of the cylinder 506 to eliminate material accumulation. The baffle plates 550 cause material to be forced into the rotating hammers 532, rather than piling up in the corner of the cylinder 506. In one embodiment, the baffle plates 550 are fabricated from 0.375 to 0.5 inch abrasion resistant plate, and are inserted in corner 511 from the cylinder 506 floor to just below a separation point between a top shell and a bottom shell (shown in FIG. 7) of the cylinder 506. The baffle plates 550 are positioned diagonally across the corner 511 at an angle that is slightly less than vertical (approximately 80 degrees). A top cover 552 is placed on top of the baffle plate 550 to prevent material from building up behind the baffle plate 550.

Figure 6:
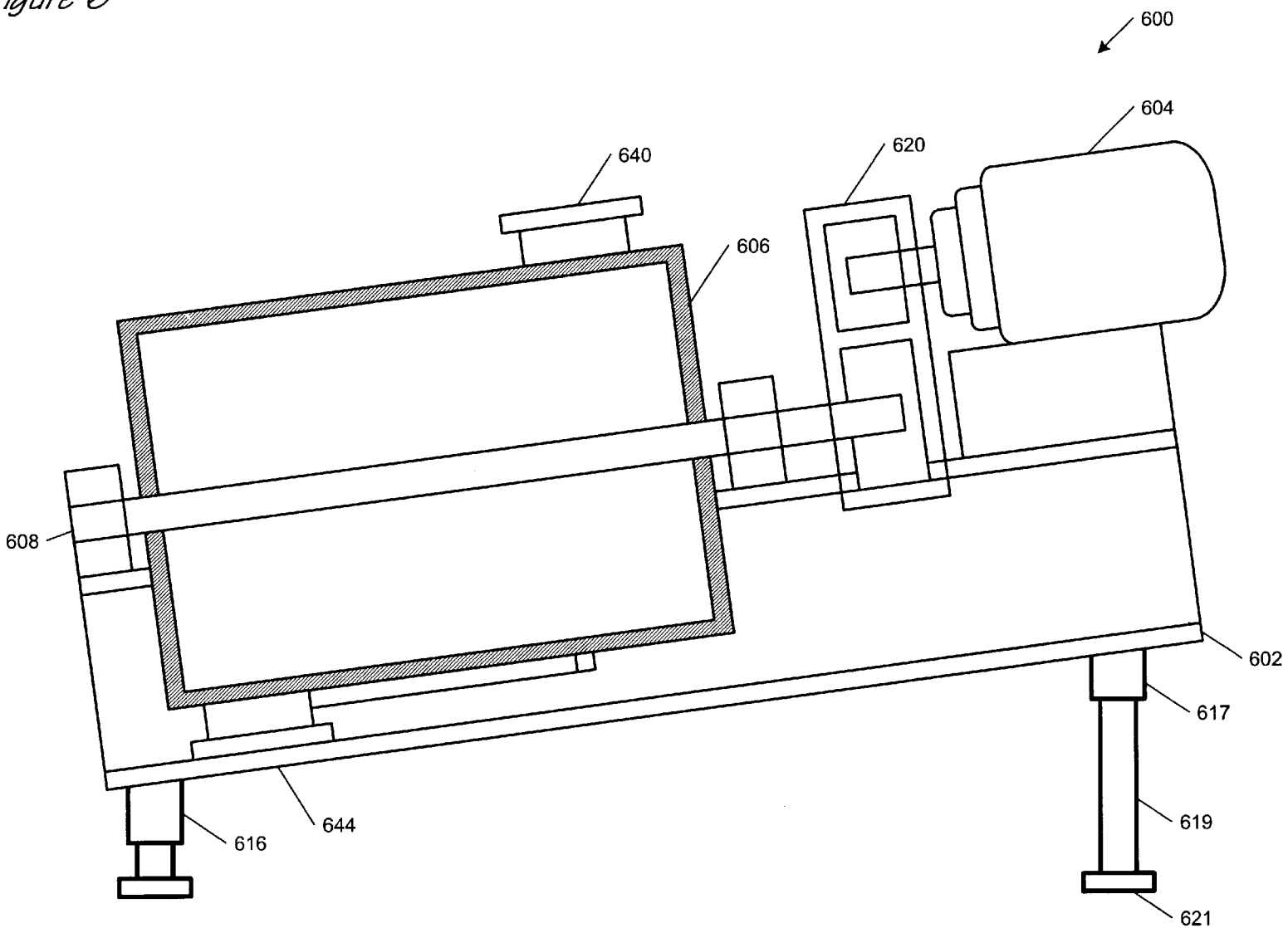
FIG. 6 is a side view of a solids reduction processor according to the present invention particularly illustrating a tilt mechanism to variably adjust the height of the inlet end of the processor.

Referring now to FIG. 6, a side view 600 is shown of the solids reduction processor of the present invention. Like elements have like references with the hundreds digit replaced by a "6". More specifically, what is shown is a means for varying the tilt of the inlet 640 side of the cylinder 606 with respect to the discharge or outlet 644 side of the cylinder 606.

The inventor of the present invention has observed that by increasing the tilt of the enclosed cylinder 606, the time that material is exposed to the rotor assemblies 608 is reduced, thereby limiting the effect that the rotor assemblies 608 have on reducing dry solids. Thus, depending on the desired output size for the reduced solids, relative to the input size, the incline of the enclosed cylinder 606 may be varied. The inventor of the present invention believes that varying the incline of the enclosed cylinder from 0 degrees (level) to 45 degrees has useful results in all angles there between.

As in FIG. 1, the processor has legs 616. Each of the legs 616 includes an outer cylinder 617, and inner cylinder 619 and a foot 621. In addition, each of the legs 616 is independently adjustable in terms of its height, with respect to the other legs 616. In one embodiment, the legs 616 utilize hydraulics to vary their length. However, since the purpose of varying the leg height is to create an incline from the outlet port 644 to the inlet port 640, thereby assisting material to flow at a predetermined rate from the inlet port 640 to the outlet port 644, one skilled in the art will appreciate that any means may be used to adjust the incline. For example, the legs 616 may utilize a manual gear/thread arrangement to adjust the height of the legs, they may use air pressure, the legs may be made of different lengths and alternatively, may even use shims between the outer cylinder 617 and the base frame 602, or between the feet 621 and the ground to create the desired incline. Additionally, a user may even place the legs on uneven ground to effectively provide a desired incline for the processing device, as taught by the present invention.

Figure 7:
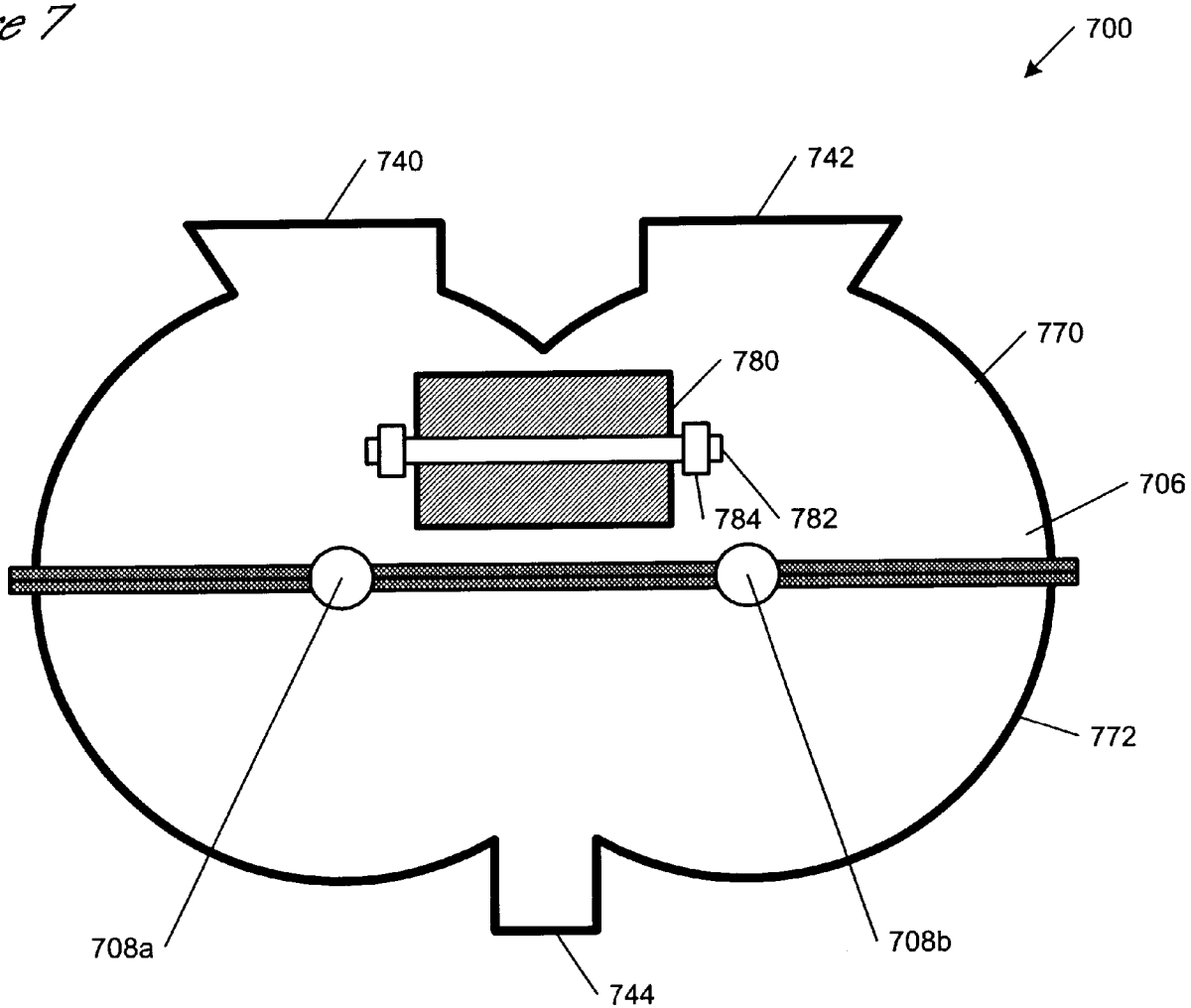
FIG. 7 is an end view of the containment cylinder particularly illustrating an inspection door on one end of the cylinder.

Referring now to FIG. 7, an end view 700 is shown of an enclosed cylinder 706. Like elements have like references with the hundreds digit replaced with a "7". As mentioned above, the enclosed cylinder 706 is actually comprised of a top shell 770 and a bottom shell 772. The top and bottom shells 770, 772 are secured together to completely enclose the chamber contents during processing, but may be separated, as needed, to install and/or repair the rotor assemblies 708*a,b*.

In addition, inspection doors 780 have been placed on each end of the cylinder 706 (i.e., the inlet end, and the outlet end) to allow for inspection of the inside of the cylinder 706 (and in some cases for cleaning of the inside of the cylinder 706) without having to remove the top and bottom shells 770, 772. In one embodiment, the inspection doors 780 are nine inch by twelve inch by one inch plates which fit securely into an opening cut through the internal wear plate within the cylinder 706, and the outer housing. The inspection doors 780 are gasketed, and held in place externally by a horizontal metal bar 782 across the middle of the door 780. The bar 782 is secured on each end by pegs 784 that fit into eyes welded to the outer wall of the cylinder 706. The inspection door 780 has been secured to the shell 770 using the bar 782 (rather than hinges, for example), to firmly secure the door 780 to the cylinder 706 during operation of the processor, while allowing for safe inspection of the interior of the cylinder 706.

Figure 8:
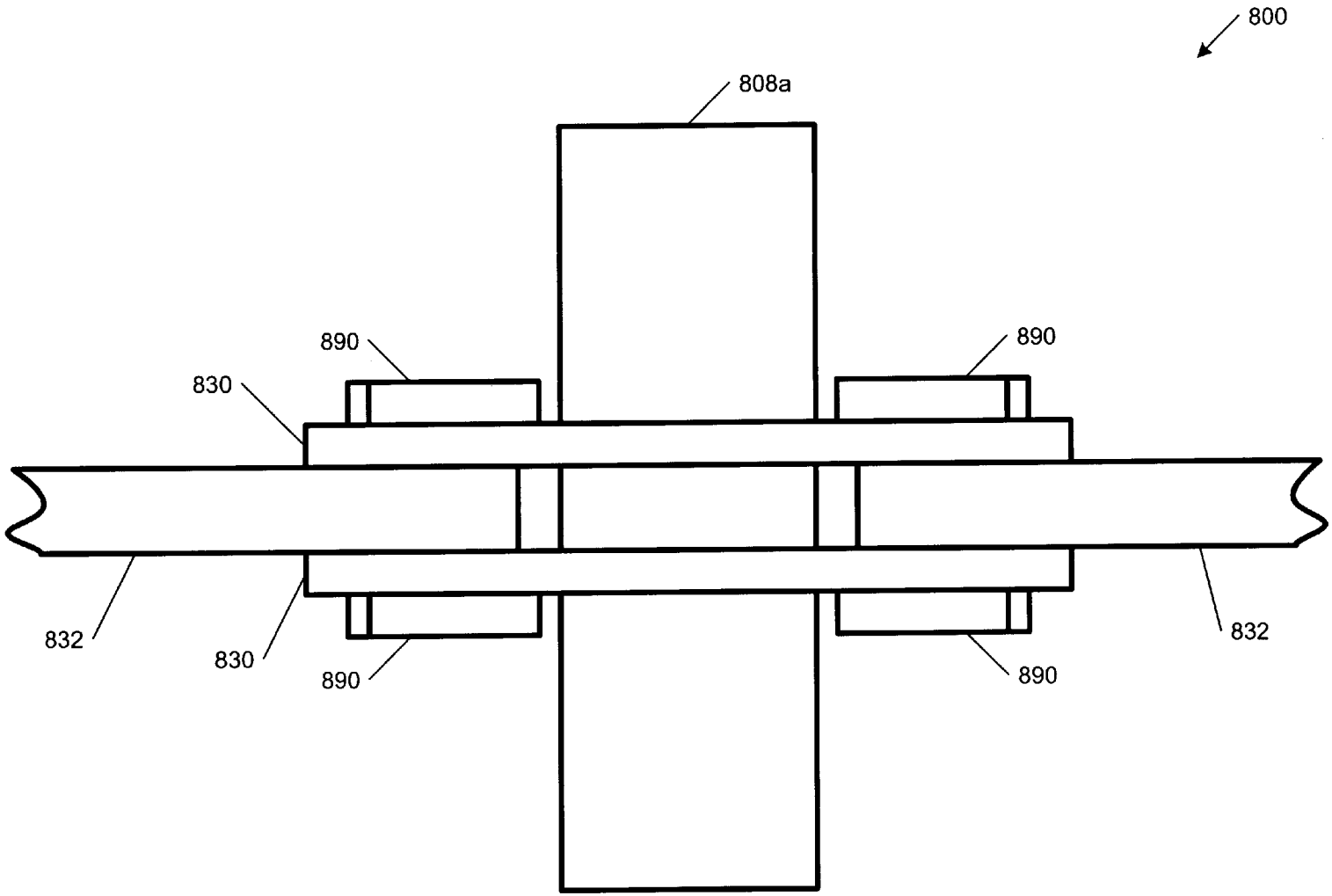
FIG. 8 is a top-down view of a disk set of the present invention particularly illustrating vains attached to the disks.

Referring now to FIG. 8, an enlarged view 800 of a portion of a rotor assembly 808*a* is shown. Like elements have like numerals, the hundreds digit being replaced by an "8". In addition, vanes 890 are shown attached to the disk sets 830. In one embodiment, the vanes 890 are made of metal bars that are approximately 6 inches long and 0.50–0.750 inches wide, and are bent to have a curvature of approximately 10 degrees. The vanes 890 are welded to a predetermined number of disk plates 830 (e.g., the first three sets of disk plates 830 on each rotor assembly 808, from the inlet port side), typically beginning with plates nearest the inlet port end, and proceeding from there to the outlet port. The inventor of the present invention believes that by welding vanes 890 to the disk plates 830 on the inlet port side of the cylinder, that mechanical impact to solids is increased, and a vacuum, or lift is created when the disk sets 830 spin at high rpm. This lift is especially beneficial in reducing dry solids introduced on the inlet side, because it increases solids suspension, and assists in the solids being carried down the cylinder towards the outlet port.

Figure 9:
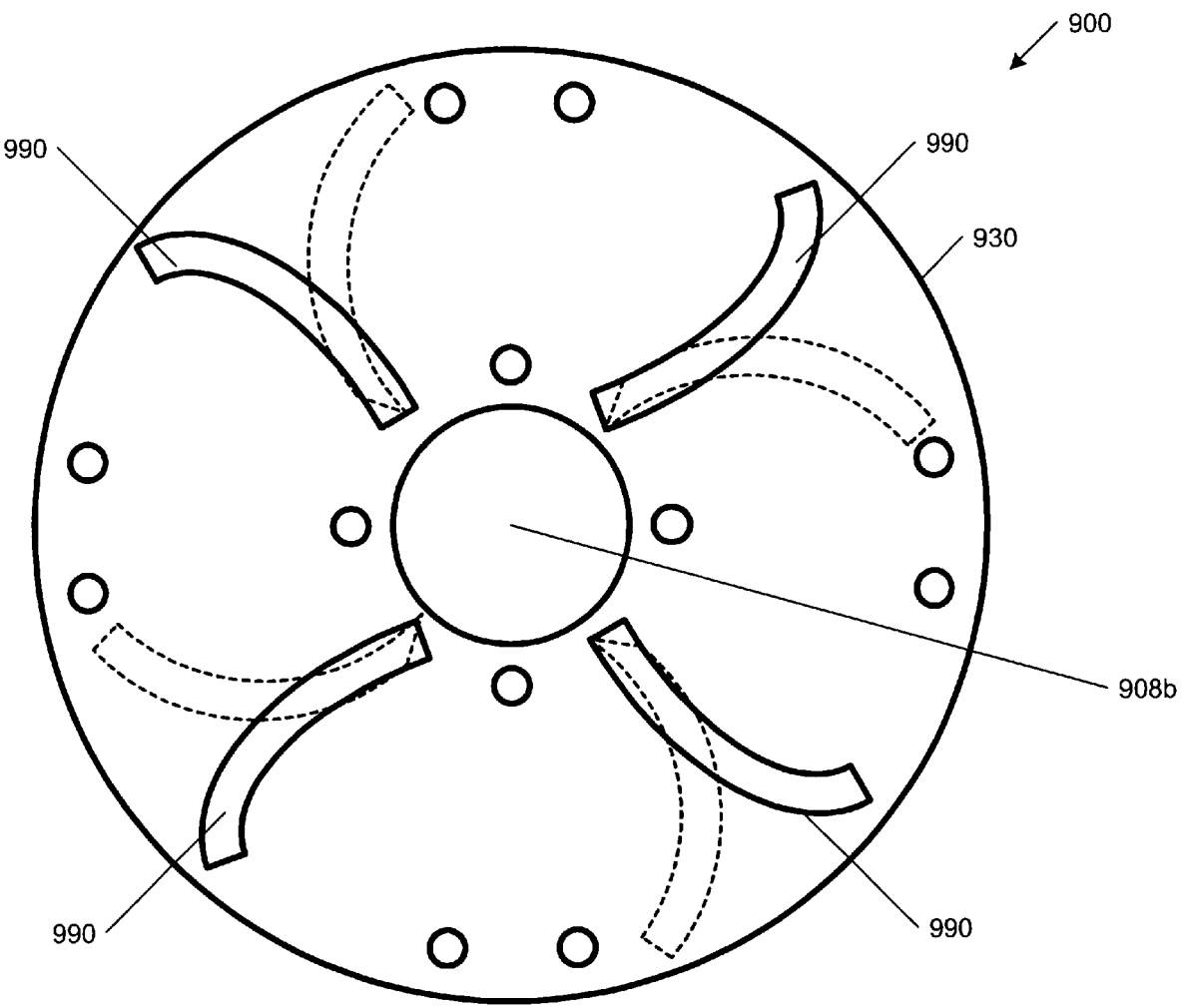
FIG. 9 is a side view of a disk particularly illustrating curved vains mounted on the disk.

Referring now to FIG. 9, an end view 900 of a disk plate 930 having four vanes 990 secured thereon is shown. The vanes 990 are shown secured to the disk plate 930 at angles 45 degrees offset from the mounting points for the hammers. In addition the vanes 990 are shown bent in the direction of rotation for the rotor assembly 908*b* (counter-clockwise). Dotted outlines show the vanes 990 bent in an opposite direction for disks that rotate in a clockwise direction. One skilled in the art will appreciate that vanes 930 might also be bent counter to the direction of rotation. That is, the inventor of the present invention believes that if the vanes 990 are bent in the direction of rotation, a scooping action will occur from the vanes 990. However, if the vanes 990 are bent opposite the direction of rotation, a vacuum or lifting effect will be created by the vanes 990. Thus, it is the use of vanes 990 secured to selected disk sets that is of interest, rather than the specific direction of the bend of the vanes 990.

Figure 10:
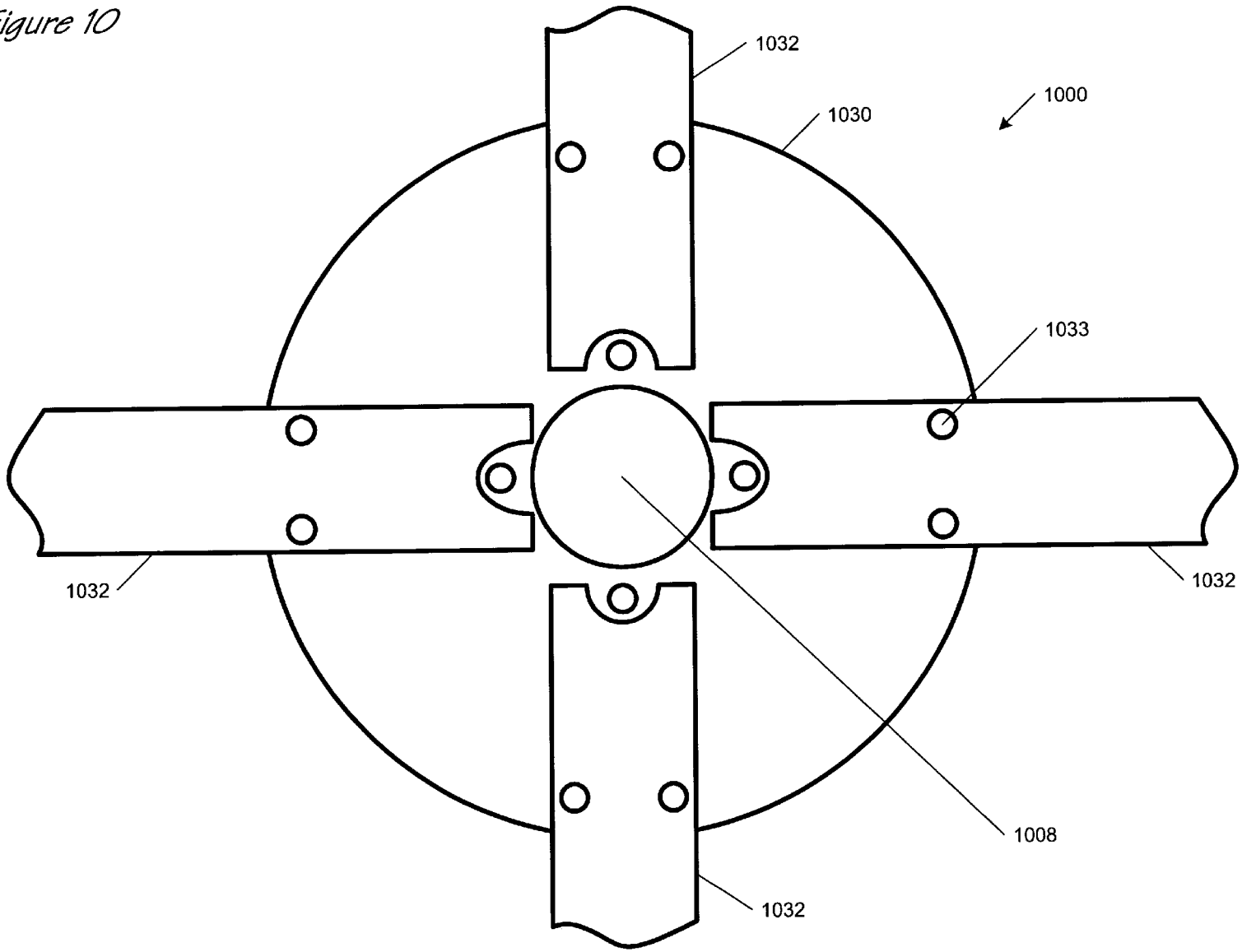
FIG. 10 is a side view of a disk particularly illustrating hammers affixed to the disk.

Referring now to FIG. 10, an end view 1000 of a disk 1030 is shown with four hammers 1032 secured thereon. In dimension, the hammers 1032 are approximately one inch by 3 inches by fourteen and three-quarter inches and are mounted in approximately 90 degree offsets from each other. The hammers 1032 are secured between disks 1030 by means such as shear pins 1033, or bolts, as desired. The securing means 1033 include an end pin positioned along the center of the hammer 1032, and two additional means, tangential to the outside radius of the disks 1030, which together hold the hammer 1032 in a fixed relationship to the disks 1030.

Figure 11:
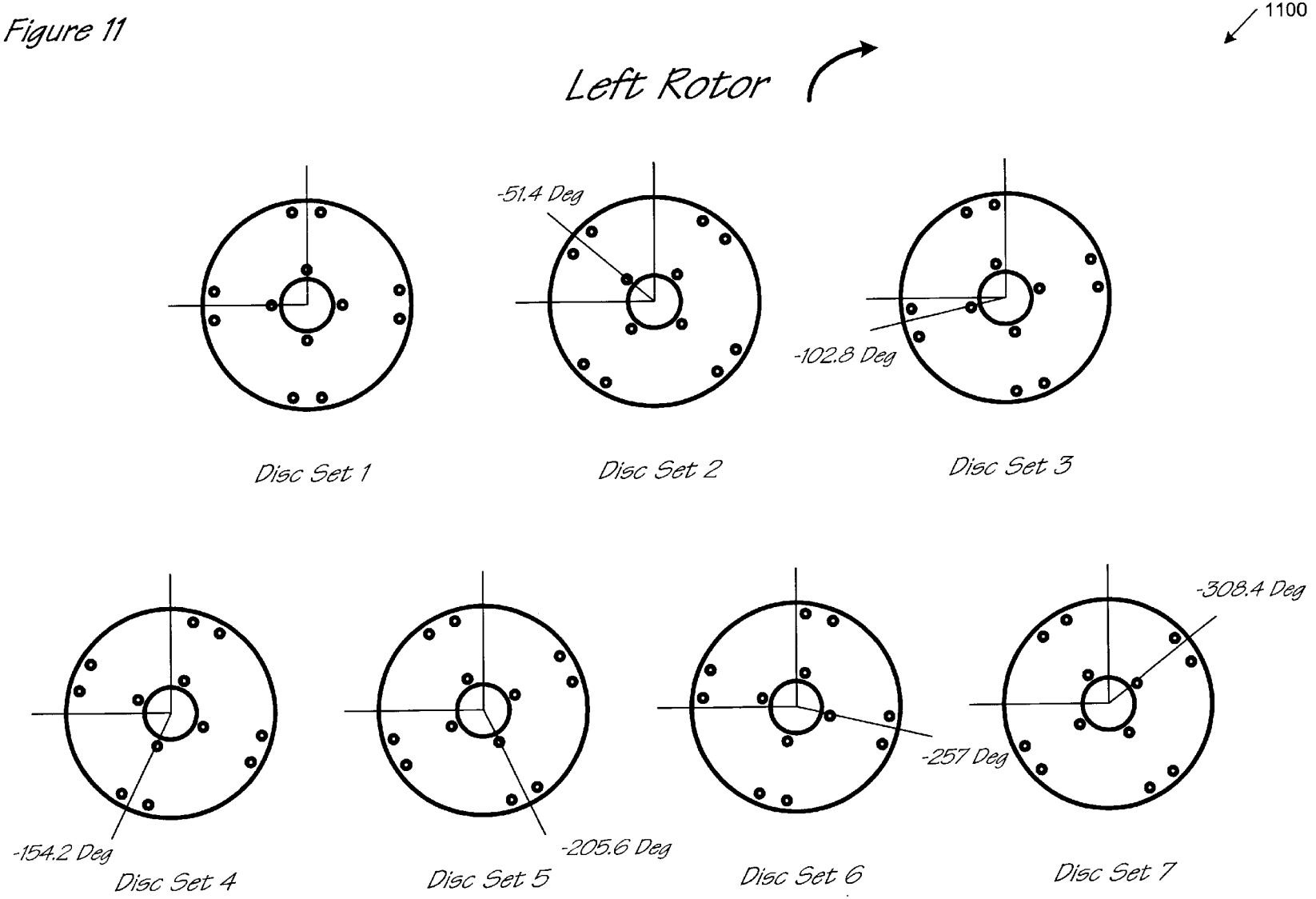
FIG. 11 is a side view of seven disk sets for the left rotor of the present invention, particularly illustrating the relative offset angle of each hammer set with respect to each other.

Referring now to FIG. 11, a diagram 1100 is shown that particularly illustrates the relative angular offset of disk sets one through seven for a left rotor assembly according to the present invention (viewed from the discharge end of the processing device). That is, each of the seven disk sets for the left rotor assembly are offset counter clockwise from each other approximately 360/7=51.4 degrees. Disk set one refers to the disk set that is closest to the inlet port of the cylinder, and disk set seven references the disk set closest to the outlet port of the cylinder. The other disk sets are displaced between disk sets one and seven with a separation of approximately seven inches between each disk set. One skilled in the art will appreciate that 360 degrees cause the materials to be processed to "corkscrew" through the machine. In some applications, this may not be preferable. A total angle of 180 degrees might be used to slow down the material flow or 720 degrees to speed up the material flow.

Figure 12:
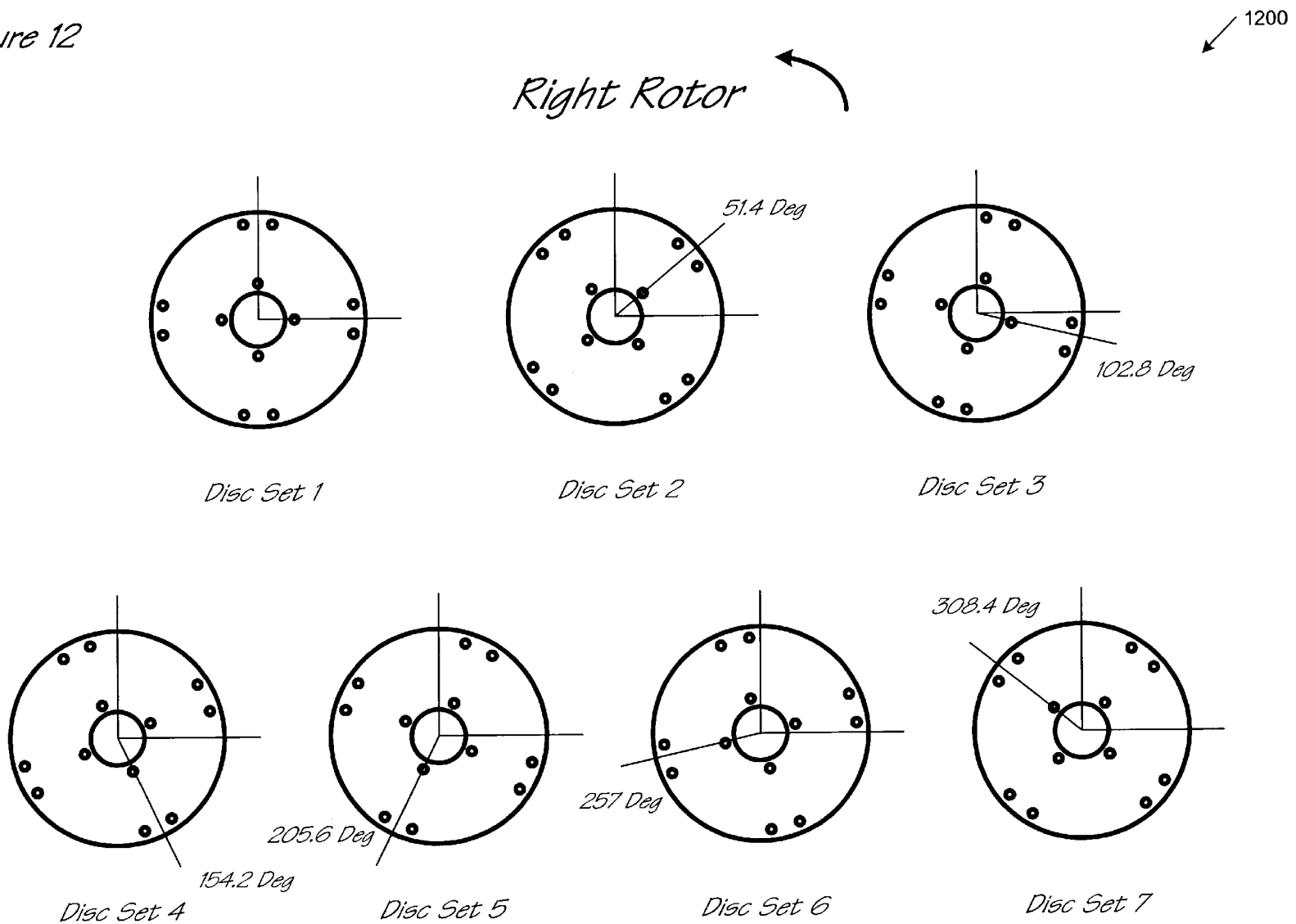
FIG. 12 is a side view of seven disk sets for the right rotor of the present invention, particularly illustrating the relative offset angle of each hammer set with respect to each other.

Referring now to FIG. 12, a diagram 1200 is shown that particularly illustrates the relative angular offset of disk sets one through seven for a right rotor assembly according to the present invention. That is, each of the seven disk sets for the right rotor assembly are offset clockwise from each other approximately 360/7=51.4 degrees (although other angles, as mentioned above might be used). Disk set one refers to the disk set that is closest to the inlet port of the cylinder, and disk set seven references the disk set closest to the outlet port of the cylinder. The other disk sets are displaced between disk sets one and seven with a separation of approximately seven inches between each disk set.

Referring back to FIG. 2, the disk sets for the rotor assemblies 208*a,b* are shown linearly offset from each other. More specifically, the disk sets 230 for the rotor assembly 208*a* are offset approximately 3.5" from the disk sets 230 for the rotor assembly 208*b*. That is, the disk sets 230 for each of the rotor assemblies 208 are placed interstitially with respect to each other to provide for maximum solids reduction between the dual rotor assemblies 208.

Figure 13:
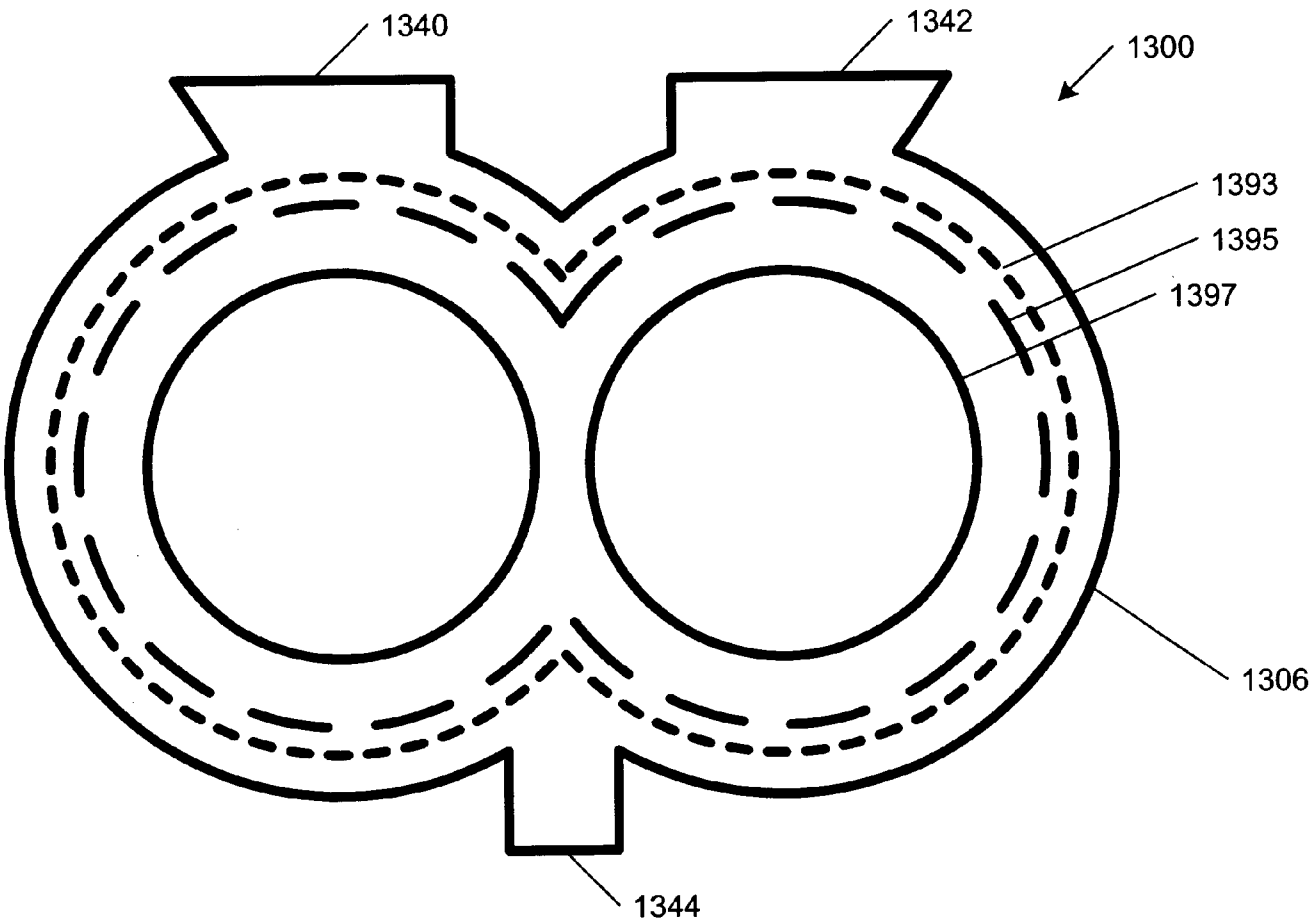
FIG. 13 is an end view of the inside of the cylinder particularly illustrating a series of flow restrictor plates secured within the cylinder.

Referring now to FIG. 13, an end view 1300 is shown of the inside of cylinder 1306 (without the rotor assemblies) according to the present invention. Like elements have like numerals, the hundreds digit replaced with a "13". In addition, the end view 1300 particularly illustrates three flow restrictor plates 1393, 1395, 1397 secured within the cylinder 1306. The flow restrictor plates 1393, 1395, 1397 are essentially doughnut shaped baffles that are welded within the cylinder 1306 from the outlet side of the cylinder 1306 towards the inlet side and are attached to the cylinder 1306 wall in a space between the rotating hammers, and sequenced such that the widest rim is closest to the outlet port 1344. The rim size of the flow restrictor plates can vary, but in one embodiment begin with a rim of 0.5 inches closest to the inlet ports 1340/134 for plate 1393 and increase in rim size to approximately 4 inches for plate 1397.

In some solids reduction applications, no flow restrictor plates are needed. However, some applications indicate that utilization of flow restrictor plates 1393, 1395, 1397 cause certain solid materials to remain in contact with the rotor assemblies longer than if they were not used. Of course, the number of flow restrictor plates used, their relative size (i.e., rim width) with respect to each other, and their placement (inlet or outlet end) will vary according to the application.

Although the present invention and its objects, features, and advantages have been described in detail, other embodiments are encompassed by the invention. For example, the rotor assemblies have been shown with seven disk sets each, with each disk set having four hammers. One skilled in the art will appreciate that the number of disk sets, and the number of hammers per disk set may vary depending on the size of the enclosed cylinder, and the particular material being reduced. Furthermore, particular dimensions have been specified for the base, the cylinder, the motors, the vanes, the hammers, the flow restrictor plates, the legs, etc. Particular dimensions are of one embodiment only, but should not be considered limiting to the present invention. Rather, the present invention presumes that alternative dimensions may be desirable in certain applications, without departing from the scope of the present invention as embodied in the appended claims. Furthermore, the application of the present invention has been described with particular reference to the processing of dry solids. However, one skilled in the art should appreciate that the invention as described has additional benefits over the prior art in the reduction of solids that may be in a liquid or slurry form.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

I claim:

1. A solids processor comprising:

an enclosed cylinder for enclosing solid materials provided thereto;

a pair of rotor assemblies, secured within said cylinder, each of said rotor assemblies for spinning disk sets to hammer said solid materials;

motor means coupled to said pair of rotor assemblies for causing said rotor assemblies to spin in opposing directions; and a pair of inlet ports provided along the top of said cylinder, each positioned directly over an associated one of said pair of rotor assemblies, at the feed end of said enclosed cylinder, for receiving said solid materials and for transmitting said solid materials to said enclosed cylinder.

2. The solids processor as recited in claim 1 wherein said enclosed cylinder comprises two cylinders that overlap along their length and share a single internal cavity.

3. The solids processor as recited in claim 1 wherein said enclosed cylinder comprises a top shell and a bottom shell that essentially mirror each other along a horizontal axis.

4. The solids processor as recited in claim 1 wherein said pair of rotor assemblies each comprise:

a rotatable shaft;

a plurality of disk sets secured along a length of said shaft; said plurality of disk sets each comprising:

a pair of disks; and a plurality of hammers secured between said pair of disks;

wherein as said rotatable shaft spins, said plurality of hammers contact said solid materials and hammer said solid materials to a reduced size.

5. The solids processor as recited in claim 4 wherein said plurality of disk sets for each of said pair of rotor assemblies are placed interstitially with respect to each other.

6. The solids processor as recited in claim 1 wherein said pair of rotor assemblies are secured within said cylinder parallel to each other.

7. The solids processor as recited in claim 1 wherein said motor means comprise a pair of motors, each of said pair of motors coupled to one of said pair of rotor assemblies.

8. The solids processor as recited in claim 7 wherein each of said pair of motors is coupled to said one of said pair of rotor assemblies with a belt.

9. The solids processor as recited in claim 1 wherein said pair of inlet ports comprise:

a left inlet port positioned with its center over one of said pair of rotor assemblies; and a right inlet port positioned with its center over a second one of said pair of rotor assemblies.

10. The solids processor as recited in claim 1 wherein said pair of inlet ports each have a dimension of 7.5" by 13.5"

11. The solids processor as recited in claim 1 further comprising:

an outlet port, provided along the bottom of said cylinder, distal to said pair of inlet ports.

12. A processing device for reducing in size solid material, the processing device comprising:

a base frame;

a pulverizer, coupled to said base frame, for receiving the solid material, and for reducing the size of said solid material; said pulverizer comprising:

an enclosed cylinder for enclosing solid material provided thereto;

a pair of rotor assemblies, secured within said cylinder, each of said rotor assemblies for spinning disk sets to hammer said solid material; and motor means coupled to said pair of rotor assemblies for causing said rotor assemblies to spin; and incline means, coupled to said base frame, for selectably adjusting the height of a first end of said pulverizer relative to a second end of said pulverizer, the adjusting being performed by said incline means without replacing said incline means with alternate incline means.

13. The processing device as recited in claim 12 wherein said incline means comprise:

a plurality of legs, each coupled to said base frame, said plurality of legs adjustable in height to selectively vary the height of said first end of said pulverizer relative to said second end of said pulverizer.

14. The processing device as recited in claim 13 wherein said plurality of legs utilize hydraulics to adjust their height.

15. The processing device as recited in claim 12 wherein said first end of said pulverizor is an input end, and said second end of said pulverizer is an output end.

16. A dry solids processor, comprising:

a base frame;

an enclosed figure eight shaped cylinder, coupled to said base frame, for enclosing solid materials provided thereto;

a pair of rotor assemblies, secured within said cylinder, each of said rotor assemblies for spinning disk sets, each of said disk sets having four hammers affixed thereon to hammer said solid materials;

a pair of motors, each one coupled to one of said pair of rotor assemblies for causing said rotor assemblies to spin;

a pair of inlet ports provided along the top of said cylinder, and each positioned over the center of an associated rotor assembly, for receiving said solid materials and for transmitting said solid materials to said enclosed cylinder; and incline means, coupled said base frame, for selectably adjusting the height of an inlet port end of said cylinder relative an outlet port end of said cylinder.

* * * * *